United States Patent [19]

Lonardi et al.

[11] Patent Number: 4,729,549

[45] Date of Patent: Mar. 8, 1988

[54] HANDLING DEVICE FOR A DISTRIBUTION SPOUT OF A SHAFT FURNACE

[75] Inventors: Emile Lonardi, Bascharage, Luxembourg; Carlo Spedener, Burlington, Canada

[73] Assignee: Paul Wurth S.A., Luxembourg, Luxembourg

[21] Appl. No.: 863,103

[22] Filed: May 14, 1986

[30] Foreign Application Priority Data

May 14, 1985 [LU] Luxembourg ..... 85899

[51] Int. Cl.[4] ..... F27B 1/20

[52] U.S. Cl. ..... 266/176; 414/207

[58] Field of Search ..... 266/176; 414/207

[56] References Cited

U.S. PATENT DOCUMENTS 4,525,120 6/1985 Legille et al. ..... 266/176

*Primary Examiner*—Melvyn J. Andrews

*Attorney, Agent, or Firm*—Fishman & Dionne

[57] ABSTRACT

A handling device for the distribution spout of a shaft furnace is presented. The handling device comprises a front axle and a rear axle with each axle being mounted on movable rollers. The axles are positioned on two rails which are opposite an access aperture in the head of the furnace. The rails are suspended underneath a working platform positioned around the furnace head with a tilting frame mounted on the front axle. A supporting cradle for the spout is freely suspended at the front end of the frame and subjected to the action of a counterweight and a supporting cable. The rear end of the frame is articulated to the front ends of two arms mounted on the rear axle. Finally, a jack is pivotably mounted between the ends of levers, the levers being affixed to the rear axle and to the rear end of the frame respectively. As a result, the two articulation points between the jack and each of the two levers, together with the articulations between the frame and the two arms of the rear axle form a triangular configuration. This triangular configuration is deformable under the action of the jack whereby the frame is caused to tilt about the axis of its supporting axle.

8 Claims, 3 Drawing Figures

HANDLING DEVICE FOR A DISTRIBUTION SPOUT OF A SHAFT FURNACE

BACKGROUND OF THE INVENTION

This invention relates to a handling device for a distribution spout of a shaft furnace. More particularly, this invention relates to a new and improved handling device for a distribution spout of a shaft furnace which is intended for dismantling and re-installing the spout.

Various types of spout handling devices are well known in the art. For example, Luxembourg Pat. No. 65 663 discloses a type of spout supporting cradle suspended from the cable of a crane. However, this device suffers from the major drawback of necessitating partial dismantling of the working platform positioned around the furnace head, in order to give passage or clearance to the spout handing device itself.

Prior art devices are also known which comprise a type of a carriage mounted on the actual working platform and which do not necessitate partial dismantling thereof. These devices, however, suffer from the drawback of being relatively complicated and cumbersome.

SUMMARY OF THE INVENTION

The above-discussed and other problems of the prior art are overcome or alleviated by the spout handling device for a distribution spout of a shaft furnace of the present invention. In accordance with the present invention, a novel spout handling device is provided which has a relatively simple construction and is relatively easy to operate.

In a first embodiment of the present invention, the handling device for the distribution spout of a shaft furnace comprises a front axle and a rear axle with each axle being mounted on movable rollers. The axles are positioned on two rails which are opposite an access aperture in the head of the furnace. The rails are suspended underneath a working platform positioned around the furnace head with a tilting frame mounted on the front axle. A supporting cradle for the spout is freely suspended at the front end of the frame and subjected to the action of a counterweight and a supporting cable. The rear end of the frame is articulated to the front ends of two arms mounted on the rear axle. Finally, a jack is pivotably mounted between the ends of levers, the levers being affixed to the rear axle and to the rear end of the frame respectively. As a result, so that the two articulation points between the jack and each of the two levers, together with the articulations between the frame and the two arms of the rear axle form a triangular configuration. This triangular configuration is deformable under the action of the jack whereby the frame is caused to tilt about the axis of its supporting axle.

Preferably, the two axles are comprised of two shafts rotatably mounted on supporting rollers. The frame may consist of two parallel arms having a central zone which is integral with the front axle. The rear ends of the parallel arms are interconnected by a shaft bearing the lever on which the jack is mounted. The supporting cable of the cradle is connected to a winch which is mounted on the frame. The winch is actuated by a motor to thereby cause the cradle to pivot about its suspension shaft at the end of the frame.

An important advantage of the handling device of the present invention (as compared with the prior art), is its simplicity in construction and operation; and in the fact that it only requires a single jack. It will be appreciated that this advantage leads to reduced manufacturing costs. A further advantage of the present invention is the fact that it consumes only a moderate amount of space. The cradle may, if necessary, be disconnected and placed in a preselected spot with the rest of the device remaining in a horizontal position and occupying very little space in the vertical direction underneath the work platform.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
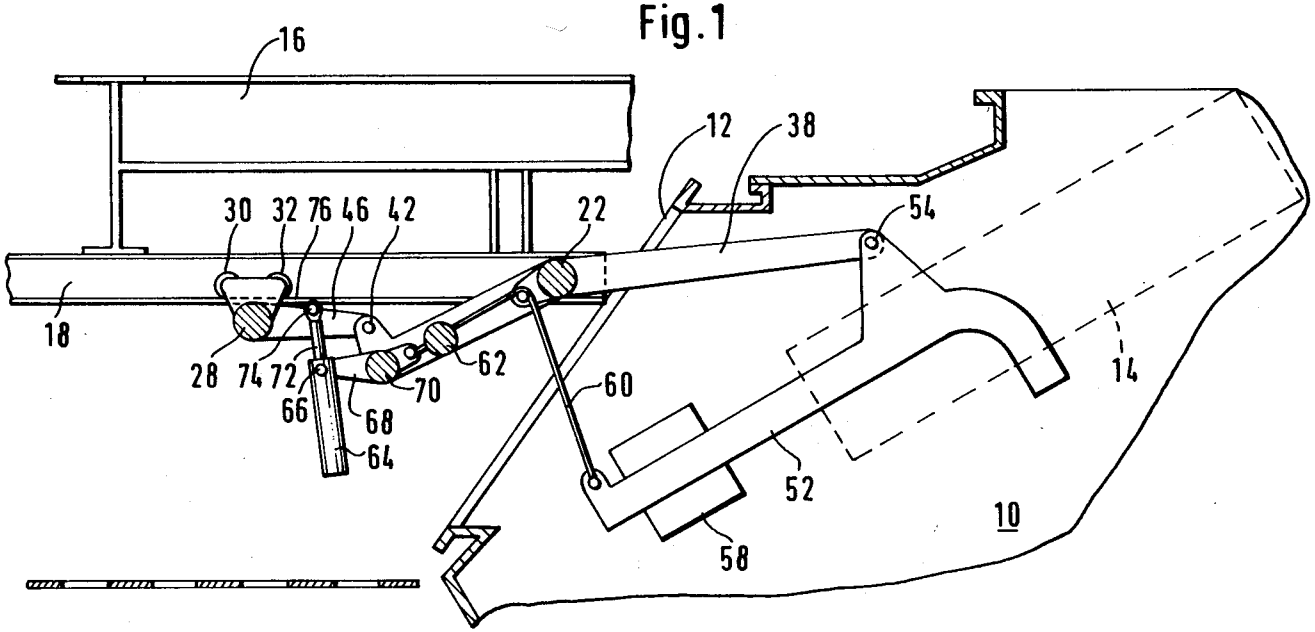
FIG. 1 is a cross-sectional elevation view of a handling device in position for the detachment of a spout in accordance with the present invention.
Figure 2:
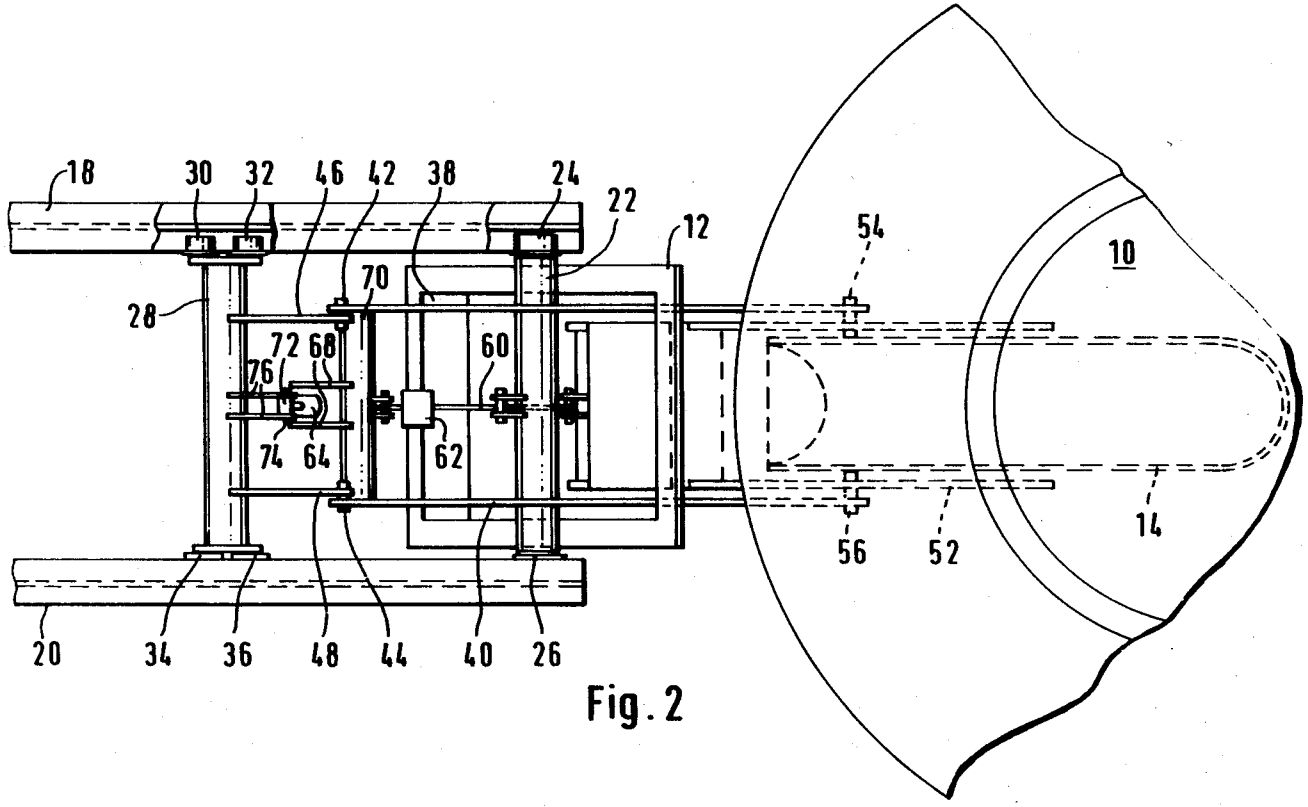
FIG. 2 is a plan view of the handling device shown in FIG. 1.
Figure 3:
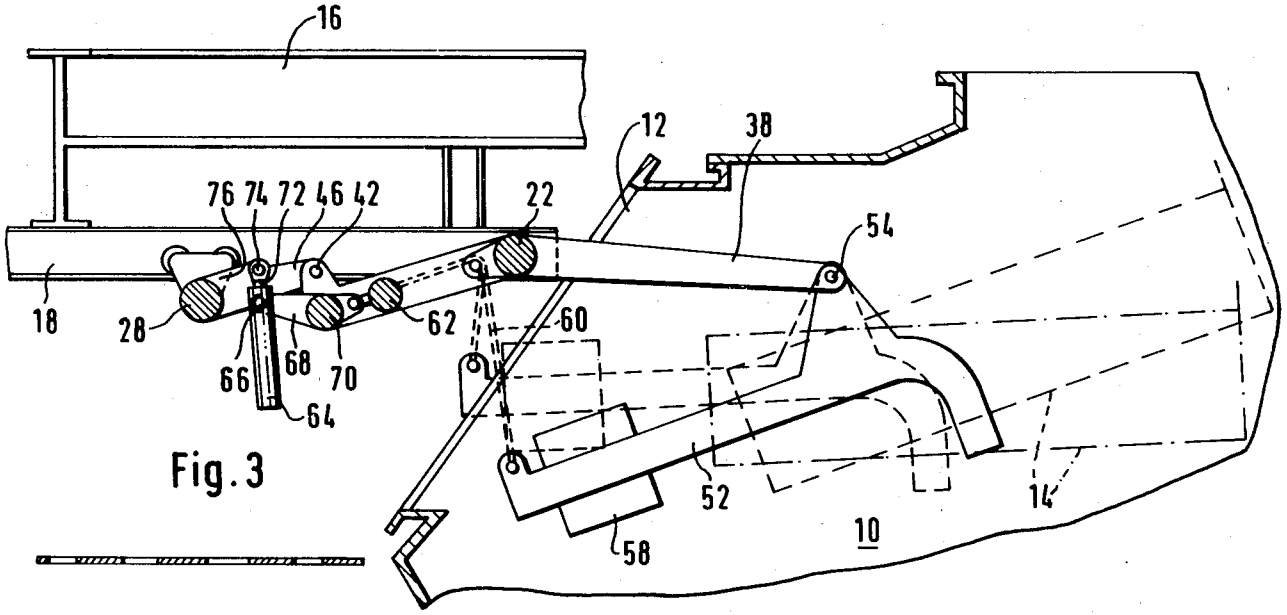
FIG. 3 is a cross-sectional elevation view analogous to the view in FIG. 1, but with the handling device in a different position.

FIGS. 1–3 are partial views of the head of a shaft furnace 10 with a lateral access aperture 12 and a distribution spout 14 (shown in broken lines) for the furnace charging material. Around furnace head 10 is a circular working platform 16. Underneath platform 16 are two rails 18 and 20. It will be appreciated that the handling device of the present invention is adapted to move along rails 18 and 20.

In accordance with the present invention, the handling device comprises a front axle 22 formed by a shaft rotatably mounted between two rollers 24 and 26, with rollers 24 and 26 being movable over rails 18 and 20. Similarly, a rear axle 28 is also comprised of a shaft which can rotate about its axis and is supported by rollers 30, 32, 34, and 36 between rails 18 and 20.

The movement of the handling device along rails 18 and 20 can be ensured by any well known means (not shown). These means may consist of, for example, a manually operated chain; a motor mounted on one of the axles for turning the roller; a rack system, etc.

A frame consisting of two slightly bent parallel arms 38 and 40 is integral with front axle 22. The rear end of each arm 38 and 40 preferably takes the form of an angled member; of which the point of the member is articulated by pivots 42 and 44 to the end of two arms 46 and 48 which are integral with rear axle 28.

A cradle 52 is suspended by two pivots 54 and 56 from the front end of the two arms 38 and 40 such that it can pivot with respect to arms 38 and 40. Cradle 52 is intended to engage spout 14 and support it under the influence of its own weight.

Cradle 52 also includes a counterweight 58 which acts in opposition to the weight of spout 14 in order to keep the latter in a raised position. To enable spout 14 to be lowered, i.e. to enable cradle 52 to rotate clockwise, cradle 52 is connected by a cable 60 to a winch 62 mounted on the frame and actuated by an electric motor or any other known acutating means.

The operation of the handling device of the present invention, particularly the pivoting of the frame about the axis of axle 22, is effected by means of a hydraulic cylinder 64 borne by pivots 66 at the end of levers 68 integral with a shaft 70 and mounted between the rear ends of arms 38 and 40 (forming the frame). The end of the piston rod 72 is articulated by means of a pivot 74 to the ends of lever 76 integral with rear axle 28. The assembly is designed such that pivots 66 and 74 (between which hydraulic jack 64 acts), in combination with the articulation axis between the frame and arms 46, 48, form a triangular configuration which is deformable under the action of jack 64.

To dismantle spout 14, the handling device is moved along rails 18 and 20 so as to convey cradle 52 through aperture 12 with jack 64 thus occupying the position shown in FIG. 1. The angle of inclination of cradle 52 is regulated by means of winch 62 (in order to adapt the angle to that of spout 14 and enable it to engage the latter). When spout 14 is supported by cradle 52, it can be detached and lowered, causing the frame to tilt clockwise. For this purpose, jack 64 is actuated so that piston rod 72 is caused to re-enter cylinder 64 and the tilting of the frame about the axis of front axle 22 causes a displacement of rear axle 28 in relation to the front axle.

After the operation of hydraulic jack 64, spout 14 occupies the position shown in broken lines in FIG. 3. Thereafter, it is conveyed into the horizontal position shown in dot-and-dash lines by raising supporting cable 60 using winch 62. The device can then be moved along rails 18 and 20, in order to extract spout 14 from aperture 12. It will be appreciated that the assembly operation comprises corresponding phases in the reverse order.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A handling device for the distribution spout of a shaft furnace including rails being suspended underneath a working platform which is positioned around the shaft furnace, the handling device comprising:

a front axle and a rear axle, each of said axles being mounted on roller means adapted for movement on rails suspended underneath a working platform positioned about the shaft furnace;

tilting frame means mounted on said front axle, said frame means having a front end and a rear end;

supporting cradle means for the distribution spout being suspended at the front end of said frame means and being associated with a counterweight and a supporting cable;

a pair of arm members, said arm members having front ends and rear ends, said rear end of said frame means being articulated to said front ends of said arm members, said arm members being mounted on said rear axle;

first lever means having a first end and a second end, and second lever means having a first and a second end;

jack means having a rod received in a cylinder, said first end of said first lever means being pivotably connected to said rod and said first end of said second lever means being pivotably connected to said cylinder; said second end of said first lever means being fixed to said rear axle and said second end of said second lever means being fixed to said rear end of said frame means thereby forming a pair of first articulation points between said jack means and each of said first and second lever means, said first articulation points and said articulation between said frame means and said two arm members defining a triangular configuration, said triangular configuration being deformable under the action of said jack means for causing said frame means to tilt about the axis of said front axle.

2. The device of claim 1 wherein:

each of said axles is comprised of a shaft rotatably mounted on supporting rollers.

3. The device of claim 1 wherein:

said frame means comprises two parallel arms having a central area which is integral with said front axle, said parallel arms having rear ends interconnected by a shaft bearing on said second lever wherein said jack means is mounted.

4. The device of claim 2 wherein:

said frame means comprises two parallel arms having a central area which is integral with said front axle, said parallel arms having rear ends interconnected by a shaft bearing on said second lever means wherein said jack means is mounted.

5. The device of claim 1 wherein said cradle means is suspended on said frame means by a suspension shaft and wherein:

said supporting cable of said cradle means is connected to a winch which is mounted on said frame means, said winch being actuated by motor means whereby said cradle means pivots about said suspension shaft at the end of said frame means.

6. The device of claim 2 wherein said cradle means is suspended on said frame means by a suspension shaft and wherein:

said supporting cable of said cradle means is connected to a winch which is mounted on said frame means, said winch being actuated by motor means whereby said cradle means pivots about said suspension shaft at the end of said frame means.

7. The device of claim 3 wherein said cradle means is suspended on said frame means by a suspension shaft and wherein:

said supporting cable of said cradle means is connected to a winch which is mounted on said frame means, said winch bieng actuated by motor means whereby said cradle means pivots about said suspension shaft at the end of said frame means.

8. The device of claim 2 wherein said cradle means is suspended on said frame means by a suspension shaft and wherein:

said supporting cable of said cradle means is connected to a winch which is mounted on said frame means, said winch being actuated by motor means whereby said cradle means pivots about said suspension shaft at the end of said frame means.

* * * * *